US008333510B2

(12) United States Patent
Ackermann et al.

(10) Patent No.: US 8,333,510 B2
(45) Date of Patent: Dec. 18, 2012

(54) PEELABLE PATCH

(75) Inventors: Marco Ackermann, Conches (CH); Christian Saclier, Annecy (FR)

(73) Assignee: Novartis AG, Basel (CH)

( * ) Notice: Subject to any disclaimer, the term of this patent is extended or adjusted under 35 U.S.C. 154(b) by 285 days.

(21) Appl. No.: 12/812,555

(22) PCT Filed: Jan. 8, 2009

(86) PCT No.: PCT/EP2009/050188

§ 371 (c)(1),
(2), (4) Date: Jul. 12, 2010

(87) PCT Pub. No.: WO2009/090139

PCT Pub. Date: Jul. 23, 2009

(65) Prior Publication Data

US 2010/0288770 A1 Nov. 18, 2010

(30) Foreign Application Priority Data

Jan. 15, 2008 (EP) ..... 08100480

(51) Int. Cl.

| | |
|---|---|
| ***B65D 65/26*** | (2006.01) |
| ***B65D 35/00*** | (2006.01) |
| ***B65D 83/04*** | (2006.01) |
| ***B65D 85/42*** | (2006.01) |
| ***B65D 73/00*** | (2006.01) |

(52) U.S. Cl. ..... 383/200; 383/207; 383/310; 222/107; 206/532; 206/469; 206/484

(58) Field of Classification Search ..... 383/200, 383/207, 210; 222/84, 107; 206/469, 484, 206/532

See application file for complete search history.

(56) References Cited

U.S. PATENT DOCUMENTS

| | | | | |
|---|---|---|---|---|
| 5,511,665 | A | 4/1996 | Dressel | |
| 6,568,533 | B1 * | 5/2003 | Tanaka et al. | 206/484 |
| 2006/0023976 | A1 * | 2/2006 | Alvater et al. | 383/210 |
| 2008/0105582 | A1 * | 5/2008 | Ludwig et al. | 206/438 |
| 2008/0190809 | A1 * | 8/2008 | Simon et al. | 206/532 |

FOREIGN PATENT DOCUMENTS

DE 10 2004 047 455 A1 4/2006

* cited by examiner

*Primary Examiner* — Nathan J Newhouse
*Assistant Examiner* — Nina Attel
(74) *Attorney, Agent, or Firm* — Diane E. Furman

(57) ABSTRACT

A peelable pouch (1) comprises: a first layer (2), a second layer (3), a compartment (4) for housing the product (7), the compartment (4) being formed between the first and second layers (2, 3) by peelably sealing the first and second layers (2, 3) along a compartment sealing portion (40), which extends along the proximal portion (23, 33) and along at least a part of the two lateral portions (20, 21, 30, 31) of the first and second layers (2, 3) as well as along first (24, 34) and second branch portions (25, 35), a first tear promoting means (50) provided on the first layer (2) only, a second tear promoting means (51) provided on the second layer (3) only, and a third tear promoting means (52) provided on both the first and second layers (2,3) and extending in a direction towards the location (26) where the first and second branch portions (24, 34, 25, 35) meet.

22 Claims, 2 Drawing Sheets

PEELABLE PATCH

Figure 1:
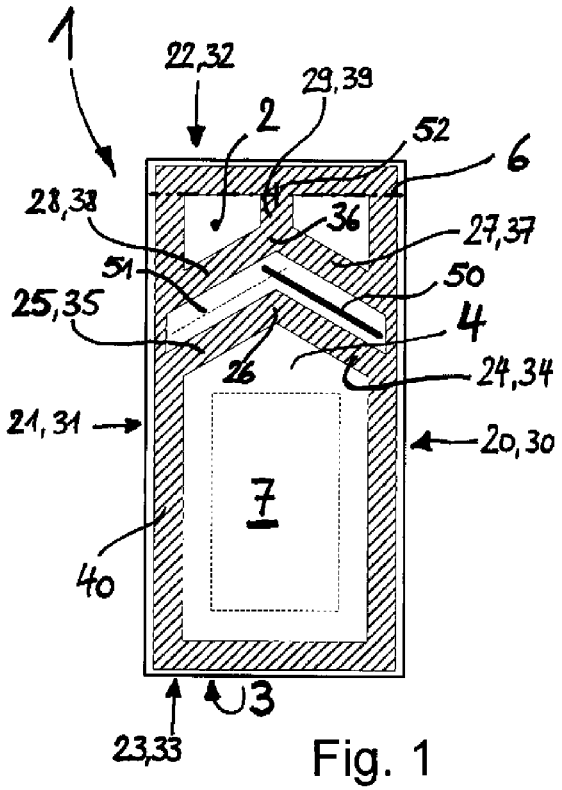

The present invention relates to a peelable pouch as it is defined by the features of the independent claim.

Orally consumable films have become important consumer products for the dispensing of various substances such as breath fresheners, pharmaceutically active compounds, and other confections. Packaging of individually contained single dosage forms, including but not limited to orally consumable films, has become increasingly popular. One obvious advantage of this in the pharmaceutical market is that packaging of individual single dosage forms reduces the risk of accidental overdose. Further, consumers appreciate the feeling obtained when opening an individually wrapped product because they know that they are the only one that has handled the actual product since it was packaged. Additionally, within individually packaged products the chances of other dosages becoming contaminated or losing efficacy from exposure to moisture, light or air is eliminated.

Some drawbacks come along with the benefits of individually packaged products. These drawbacks may not be of much consequence in some of the frequent uses of orally consumable films, that is, for candy, breath fresheners and the like. However, they may be more important for pharmaceutically active products. Individually wrapped products, especially small products such as medications, often resemble candy to a small child. Written warnings as to the contents are ineffective for children who cannot read.

In WO 2006/017462 a peelable pouch has been suggested to overcome many of the drawbacks mentioned above. In one embodiment the peelable pouch comprises an essentially rectangular compartment for containing the film, and which is provided with a tear promoting slit in the lateral peripheral portion of the of the pouch where it is sealed. The tear promoting slit points towards the compartment housing the product and is arranged near the upper end of the compartment at a distance from the lateral outer edge of the pouch so that a child cannot accidentally open it. Rather, in order to be able to open the pouch the pouch must be folded (at least partially along a folding line) across the tear promoting slit so as to access the slit and to allow the pouch to be torn along the slit until the tear so produced extends fully transverse across the upper end of the compartment, so that the upper end portion of the pouch has been torn off. Once this first tearing step has been completed, the two layers of the pouch must be grabbed with the fingers and must be peeled along the lateral peelably sealed portions of the pouch so as to open the compartment and get access to the film contained therein.

While this pouch is believed to be "child-resistant", meaning that a child may not accidentally open the pouch, it still has certain drawbacks. First of all, in case the product is not critical such as is the case with candys or breath fresheners, then the package is still child-resistant and a child may not be able to open it although this may be desirable. However, more importantly the procedure of getting access to the film housed in the compartment by first tearing off the upper portion of the pouch, throwing away the torn off upper portion, grabbing the two layers of the pouch again and peeling them apart is cumbersome.

Accordingly, it is an object of the invention to suggest a peelable pouch which is more convenient to open, which is simple to manufacture, and which may or may not be child-resistant depending on the product to be contained in the compartment.

This object is achieved by the peelable pouch according to the present invention as it is characterized by the features of the independent claim. Advantageous embodiments of the pouch according to the invention are the subject of the dependent claims.

In particular, the peelable pouch for containing at least one product, comprises:

- a first layer having a peripheral portion comprising two lateral portions, a distal portion and a proximal portion;
- a second layer having a peripheral portion comprising two lateral portions, a distal portion and a proximal portion, which correspond to the respective portions of the first layer;
- a compartment for housing the product, the compartment being formed between the first and second layers by peelably sealing the first and second layers along a compartment sealing portion, which extends along the proximal portion and along at least a part of the two lateral portions of the first and second layers as well as along first and second branch portions, the first and second branch portions extending obliquely to the lateral, distal and proximal portions and meeting one another such that the compartment sealing portion defines a closed boundary defining the shape of the compartment;
- a first tear promoting means provided on the first layer only and extending in a direction towards one of the lateral portions;
- a second tear promoting means provided on the second layer only and extending towards the other one of the lateral portions;
- a third tear promoting means provided on both the first and second layers and extending in a direction towards the location where the first and second branch portions meet.

Depending on where the third tear promoting means (e.g. a slit) is arranged, the pouch can be "child-resistant" or not. A user who wants to open the pouch is to grab the two portions at both sides of the third tear promoting means and to push one portion toward the back and to pull the other portion towards the front. This causes the third tear promoting means to tear until the tear so produced reaches the first and second tear promoting means (e.g. slits) which are provided on the first layer only and on the second layer only, respectively. The pouch is then further torn along the first tear promoting means and along the second tear promoting means while continuing to perform the same "push-and-pull" movement until the pouch is completely torn along the first and second tear promoting means. The film is thus exposed and can be easily accessed by the user. At the same time, the pouch is simple to manufacture.

In one embodiment of the peelable pouch according to the invention, the first tear promoting means extends essentially parallel to the first branch portion and the second tear promoting means extends essentially parallel to the second branch portion. This embodiment shows a good behaviour during opening of the pouch.

In another embodiment of the peelable pouch according to the invention, the third tear promoting means starts directly at the outer edge of the distal portion and extends in the direction towards the location where the first and second branch portions meet. This embodiment is advantageous in case the product (e.g. film) contained in the compartment is not critical, such as a candy or a breath freshener. It also allows children to easily get access to the product contained in the compartment.

In another embodiment of the peelable pouch according to the invention, the third tear promoting means starts at a distance away from the outer edge of the distal portion and extends in the direction towards the location where the first and second branch portions meet. This embodiment is "child resistant" since an attempt to tear the pouch along the third tear promoting means fails.

In accordance with a further aspect of the afore-mentioned embodiment, a folding line is provided which runs parallel to the outer edge of the distal portion at a distance which is such that the folding line crosses the third tear promoting means. As the pouch is folded along the folding line, the third tear promoting means (e.g. the slit) becomes accessible and the "push-and-pull" movement can be performed as described above in order to open the pouch and get access to the product contained in the compartment. It goes without saying that this embodiment is particularly suitable when the product contains a pharmaceutically active substance, or in case for any reason the pouch is desired to be "child-resistant".

In accordance with a further aspect of the afore-mentioned embodiment, the folding line is provided by a marking which is printed onto the outer surface of the first and/or the second layer. Such a printed marking is a suitable indication to the user where to fold the pouch.

As already mentioned, in accordance with a further aspect of the invention, the first tear promoting means and/or the second tear promoting means and/or the third tear promoting means is a perforated line, a slit or a line of weakness. They can be produced by using well-known techniques to produce the perforations, the slits or the lines of weakness.

In accordance with a further embodiment of the pouch of the present invention, the third and fourth branch portions are provided where the first and second layers are peelably sealed to one another, the third and fourth branch portions running parallel to and at a distance away from the first and second branch portions and meet one another such that the first and second tear promoting means are located between the first and third and second and fourth branch portions, respectively. This increases the simplicity of handling the pouch during opening due to an improved tearing behaviour of the pouch.

In a further aspect of the afore-mentioned embodiment of the pouch according to the invention, the first and second layers are peelably sealed along the distal portion, and wherein a fifth branch portion is provided where the first and second layers are peelably sealed to one another, the fifth branch portion extending from the location where the third and fourth branch portions meet to the distal portion, where the first and second layers are peelably sealed. This embodiment further improves the tearing behaviour of the pouch and, therefore, the handling of the pouch during opening is still further improved.

In another embodiment of the pouch according to the invention sealing areas are provided at the distal portion only at the corners of the distal portion, with the first and second layers being peelably sealed at the sealing areas. This is an alternative embodiment which is working well and reduces the manufacturing expense since the portions to be sealed are smaller than those of the above-described embodiment.

Figure 2:
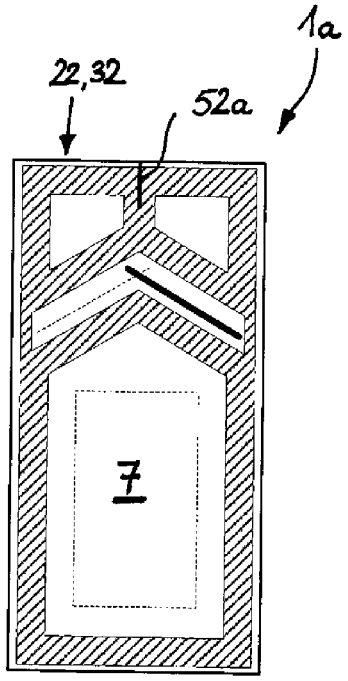
Figure 3:
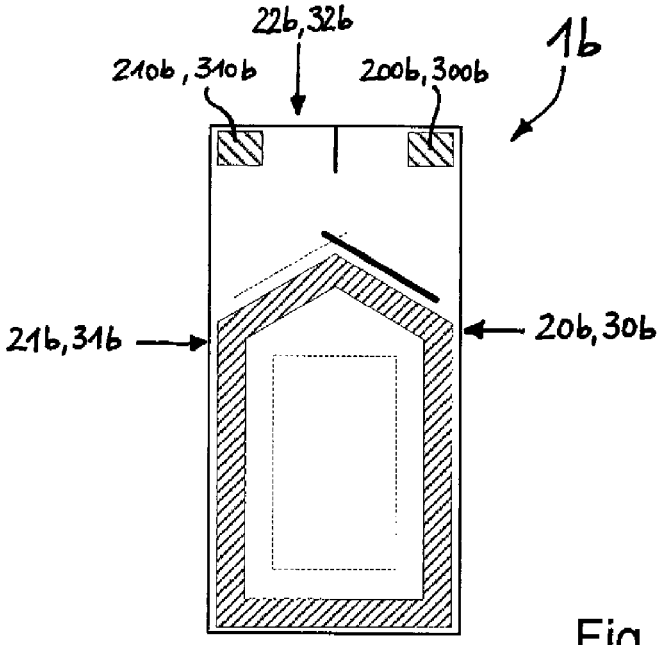
Figure 4:
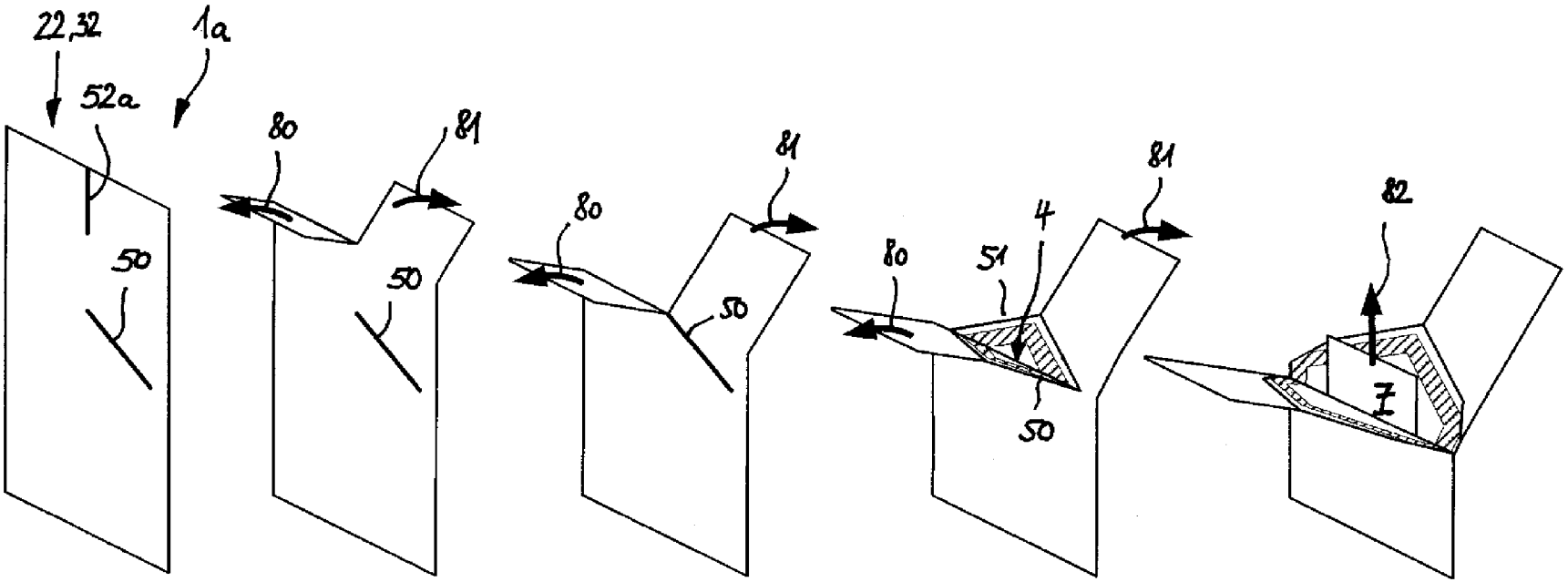

Further advantageous aspects of the invention become apparent from the following detailed description of embodiments of the pouch according of the invention with the aid of the drawings in which:

FIG. 1 shows a first embodiment of the peelable pouch according to the invention, FIG. 2 shows a second embodiment of the peelable pouch according to the invention, FIG. 3 shows a third embodiment of the peelable pouch according to the invention, and FIG. 4 shows a sequence illustrating the operations to be performed in order to open the embodiment of the pouch shown in FIG. 2.

In FIG. 1 a first embodiment of the peelable pouch 1 according to the invention is shown. It comprises a first layer, here the top layer 2, and a second layer, here the base layer 3. Each layer 2, 3 has two lateral portions 20, 21, 30, 31, a distal portion 22, 32 and a proximal portion 23, 33, respectively. Top layer 2 and base layer 3 are peelably sealed, with those portions being sealed being shown hatched. A compartment 4 is formed between first layer 2 and second layer 3 through sealing the first and second layers along a compartment sealing portion 40, which extends along proximal portions 23,33, along a part of the two lateral portions 20, 21, 30, 31, and along first and second branch portions 24, 25, 34, 35 of first layer 2 and second layer 3, respectively. First and second branch portions 24, 25, 34, 35 extend obliquely to the lateral, distal and proximal portions towards the interior of pouch 1, and meet one another at a location 26, so that compartment sealing portion 40 defines a closed boundary which defines the shape of compartment 4.

Third and fourth branch portions 27, 28, 37, 38 are provided where first and second layers 2, 3 are also peelably sealed. Third and fourth branch portions 27, 28, 37, 38 in this embodiment (although not mandatory) run parallel to and at a distance away from the first and second branch portions 24, 25, 34, 35, respectively, and meet at location 36. From location 36 towards distal portions 22,32 extends a fifth branch portion 29, 39, where first and second layers 2, 3 are peelably sealed. Finally, there are additional sealing portions (shown hatched) extending along lateral portions 20, 21, 30, 31, as well as along distal portions 22, 32.

A first tear promoting means is provided only on first layer 2 in form of a slit 50 extending between and parallel to first and third branch portions 24, 27, 34, 37. In a similar manner, a second tear promoting means is provided only on second layer 3 in form of a slit 51 extending between and parallel to second and fourth branch portions 25, 28, 35, 38. A third tear promoting means in form of a slit 52 is provided on both the first layer 2 and the second layer 3. Slit 52 is arranged to start at a distance away from the outer edge of distal portion 22, 32 of the first and second layers and extends in a direction towards location 26 where the first and second branch portions 24, 34, 25, 35 (and also towards location 36 where third and fourth branch portions 24, 25, 34, 35 meet). Also, slit 52 is arranged to run along a part of fifth branch portion 29, 39.

As can further be seen in FIG. 1, there is a folding line 6 that runs parallel to the outer edge of distal portions 22, 32 and is arranged at a distance from the outer edge of distal portion 22,32 such that folding line 6 crosses slit 52. Folding line 6 can be provided by a marking being printed onto the outer surface of the first or second layer 2, 3, or on both layers.

Finally, a product such as a film 7 is indicated through hatching as being contained in compartment 4. The way how to get access to film 7 will be described in more detail with respect to FIG. 4.

FIG. 2 shows a second embodiment of the pouch 1*a* according to the invention, which is relatively similar to the embodiment of the pouch 1 shown in FIG. 1. Therefore, like parts are assigned like reference signs in the following description of pouch 1*a* shown in FIG. 2, which is limited only to the differences between the embodiment of pouch 1*a* when compared with pouch 1. This difference is the arrangement of the third tear promoting means in form of slit 52*a*, which starts directly at the outer edge of distal portions 22, 32 and is longer than slit 52 of pouch 1. This difference will be referred to in the description of the way how to access to film 7.

A third embodiment of the pouch 1*b* according to the invention is shown in FIG. 3. Again, like parts are assigned like reference numberals when compared to the embodiments shown in FIG. 1 and FIG. 2. The third embodiment of pouch 1*b* is similar to the embodiment of the pouch 1*a* shown in FIG. 2, however, instead of being sealed along the entire lateral portions 20*b*, 30*b*, 21*b*, 31*b* and along the entire distal portions 22*b*, 32*b*, only two sealing areas 200*b*, 300*b*, 210*b*, 310*b* are provided at the respective corner of distal portions 22*b* and 32*b*.

The following description of the way how to get access is particularly directed to the embodiment 1*a* of the pouch shown in FIG. 2. It applies in similar manner to the embodiment of the pouch 1*b* shown in FIG. 3. With respect to the embodiment of the pouch 1 shown in FIG. 1, the only difference is, that in order to get access to slit 52 the user must fold the pouch along folding line 6 in order to be able to start tearing the pouch along slit 52. This arrangement of slit 52 makes pouch 1 "child-resistant" while the embodiment of the pouch 1*a* and the embodiment of the pouch 1*b* are not "child-resistant".

As shown in FIG. 4 the representation of pouch 1*a* shown on the very left shows pouch 1*a* in its closed state with film 7 being contained in compartment 4. Slit 52*a* as well as slit 50 can be seen in that representation as well. According to the representation second from the left, in order to get access to film 7 the user has to grab the left half of the distal portions 22, 32 of pouch 1*a* and pull them in the direction of arrow 80, while at the same time pushing the right half of the distal portions 22, 32 of pouch 1*a* in the direction of arrow 81 so that the pouch starts to rupture in the direction towards the locations 26, 36 (see FIG. 1) until the tear so produced reaches the slits 50,51, respectively, see central representation in FIG. 4. Since slit 50 is provided only on the first layer 2 and slit 51 is provided only on second layer 3, rupturing of pouch 1*a* continues along slits 50 and 51, respectively, as this is shown in the representation second from the right in FIG. 4, while the push-and-pull movement is simply continued. At this time, first layer 2 is peeled off from second layer 3, thus starting to open compartment 4. As pouch 1*a* has completely ruptured along slits 50 and 51, first layer 2 is further peeled off from second layer 3 in along the compartment sealing portions running along the lateral portions 20, 30 and 21, 31, respectively. Strip 7 is thus exposed to an extent that the user may grip it and take it out of pouch 1*a* as this is indicated in FIG. 4 by arrow 82 or may even take it directly in the mouth without touching the product.

It goes without saying that the layers of the pouch must be sealable at least in those areas which are intended to be sealed. Also, instead of providing slits 50, 51, 52, 52*a*, it is well conceivable to provide other suitable tear promoting means such as perforated lines or other lines of weakness, so that the pouch ruptures along such line as it is opened in the manner described above.

The invention claimed is:

1. A peelable pouch for containing at least one product, comprising:

a first layer having a peripheral portion comprising two lateral portions, a distal portion and a proximal portion;

a second layer having a peripheral portion comprising two lateral portions, a distal portion and a proximal portion, which correspond to the respective portions of the first layer;

a compartment for housing the product, the compartment being formed between the first and second layers by peelably sealing the first and second layers along a compartment sealing portion, which extends along the proximal portion and along at least a part of the two lateral portions of the first and second layers as well as along first and second branch portions, the first and second branch portions extending obliquely to the lateral, distal and proximal portions and meeting one another such that the compartment sealing portion defines a closed boundary defining the shape of the compartment;

a first tear promoting means provided on the first layer only and extending in a direction towards one of the lateral portions;

a second tear promoting means provided on the second layer only and extending towards the other one of the lateral portions;

a third tear promoting means provided on both the first and second layers and extending in a direction towards the location where the first and second branch portions meet.

2. A peelable pouch according to claim 1, wherein the first tear promoting means extends essentially parallel to the first branch portion and the second tear promoting means extends essentially parallel to the second branch portion.

3. A peelable pouch according to claim 2, wherein the third tear promoting means starts directly at an outer edge of the distal portion and extends in the direction towards the location where the first and second branch portions meet.

4. A peelable pouch according to claim 3, wherein the first tear promoting means and/or the second tear promoting means and/or the third tear promoting means is a perforated line, a slit or a line of weakness.

5. A peelable pouch according to claim 3, wherein third and fourth branch portions are provided where the first and second layers are peelably sealed to one another, the third and fourth branch portions running parallel to and at a distance away from the first and second branch portions and meet one another such that the first and second tear promoting means are located between the first and third and second and fourth branch portions, respectively.

6. A peelable pouch according to claim 3, wherein sealing areas are provided at the distal portion only at corners of the distal portion, with the first and second layers being peelably sealed at the sealing areas.

7. A peelable pouch according to claim 2, wherein the third tear promoting means starts at a distance away from an outer edge of the distal portion and extends in the direction towards the location where the first and second branch portions meet.

8. A peelable pouch according to claim 7, wherein a folding line is provided which runs parallel to the outer edge of the distal portion at a distance which is such that the folding line crosses the third tear promoting means.

9. A peelable pouch according to claim 8, wherein third and fourth branch portions are provided where the first and second layers are peelably sealed to one another, the third and fourth branch portions running parallel to and at a distance away from the first and second branch portions and meet one another such that the first and second tear promoting means are located between the first and third and second and fourth branch portions, respectively.

10. A peelable pouch according to claim 9, wherein the first and second layers are peelably sealed along the distal portion, and wherein a fifth branch portion is provided where the first and second layers are peelably sealed to one another, the fifth branch portion extending from the location where the third and fourth branch portions meet to the distal portion, where the first and second layers are peelably sealed.

11. A peelable pouch according to claim 1, wherein the third tear promoting means starts directly at an outer edge of the distal portion and extends in the direction towards the location where the first and second branch portions meet.

12. A peelable pouch according to claim 11, wherein the first tear promoting means and/or the second tear promoting means and/or the third tear promoting means is a perforated line, a slit or a line of weakness.

13. A peelable pouch according to claim 1, wherein the third tear promoting means starts at a distance away from an outer edge of the distal portion and extends in the direction towards the location where the first and second branch portions meet.

14. A peelable pouch according to claim 13, wherein a folding line is provided which runs parallel to the outer edge of the distal portion at a distance which is such that the folding line crosses the third tear promoting means.

15. A peelable pouch according to claim 14, wherein the folding line is provided by a marking being printed onto the outer surface of the first and/or the second layer.

16. A peelable pouch according to claim 14, wherein the first tear promoting means and/or the second tear promoting means and/or the third tear promoting means is a perforated line, a slit or a line of weakness.

17. A peelable pouch according to claim 14, wherein third and fourth branch portions are provided where the first and second layers are peelably sealed to one another, the third and fourth branch portions running parallel to and at a distance away from the first and second branch portions and meet one another such that the first and second tear promoting means are located between the first and third and second and fourth branch portions, respectively.

18. A peelable pouch according to claim 17, wherein the first and second layers are peelably sealed along the distal portion, and wherein a fifth branch portion is provided where the first and second layers are peelably sealed to one another, the fifth branch portion extending from the location where the third and fourth branch portions meet to the distal portion, where the first and second layers are peelably sealed.

19. A peelable pouch according to claim 1, wherein the first tear promoting means and/or the second tear promoting means and/or the third tear promoting means is a perforated line, a slit or a line of weakness.

20. A peelable pouch according to claim 1, wherein third and fourth branch portions are provided where the first and second layers are peelably sealed to one another, the third and fourth branch portions running parallel to and at a distance away from the first and second branch portions and meet one another such that the first and second tear promoting means are located between the first and third and second and fourth branch portions, respectively.

21. A peelable pouch according to claim 20, wherein the first and second layers are peelably sealed along the distal portion, and wherein a fifth branch portion is provided where the first and second layers are peelably sealed to one another, the fifth branch portion extending from the location where the third and fourth branch portions meet to the distal portion, where the first and second layers are peelably sealed.

22. A peelable pouch according to claim 1, wherein sealing areas are provided at the distal portion only at the corners of the distal portion, with the first and second layers being peelably sealed at the sealing areas.

* * * * *